United States Patent [19]

Inoue

[11] Patent Number: 4,759,175

[45] Date of Patent: Jul. 26, 1988

[54] DEVICE FOR APPLICATION OF LUBRICANT LIQUID TO YARN ON DOUBLE TWISTER

[75] Inventor: Yoshihisa Inoue, Ibaragi, Japan

[73] Assignee: Murata Kikai Kabushiki Kaisha, Kyoto, Japan

[21] Appl. No.: 928,309

[22] Filed: Nov. 6, 1986

[30] Foreign Application Priority Data

Nov. 11, 1985 [JP] Japan ..... 60-252457

[51] Int. Cl.[4] ..... D01H 13/30; D01H 7/86; B05C 1/06

[52] U.S. Cl. ..... 57/296; 57/58.83; 57/58.86; 118/234; 118/264; 118/268; 118/DIG. 22

[58] Field of Search ..... 57/295–297, 57/58.49, 58.7, 58.83, 58.86, 120; 118/234, 264–268, DIG. 18–DIG. 22; 418/90; 184/64; 384/181, 369

[56] References Cited

U.S. PATENT DOCUMENTS

| | | | |
|---|---|---|---|
| 710,928 | 10/1902 | Winton | 184/64 |
| 1,577,643 | 3/1926 | Jorgensen et al. | 184/64 |
| 1,743,894 | 1/1930 | Johnson | 184/64 X |
| 2,525,997 | 10/1950 | Beier | 118/234 X |
| 2,875,727 | 3/1959 | Robinson | 118/268 |
| 3,002,587 | 10/1961 | Matson | 184/64 X |
| 3,295,306 | 1/1967 | Rehn | 57/296 X |
| 3,864,901 | 2/1975 | Beymes et al. | 57/296 |
| 4,023,337 | 5/1977 | Speranzin | 57/296 |
| 4,573,314 | 3/1986 | Lorenz | 57/296 |
| 4,641,493 | 2/1987 | Fukunaga | 57/296 |

*Primary Examiner*—John Petrakes
*Attorney, Agent, or Firm*—Spensley Horn Jubas & Lubitz

[57] ABSTRACT

A device for application of lubricant liquid to a yarn on double twister comprising a rigid porous wetting member disposed in a part of the yarn passage through which the yarn drawn from a feeding package passes and adapted to be in contact with the drawn yarn, a tank for reserving lubricant liquid to be applied to the yarn, and a plurality of wicks immersed into lubricant liquid in the tank at one end and brought into contact with the wetting member at the other end.

8 Claims, 3 Drawing Sheets

DEVICE FOR APPLICATION OF LUBRICANT LIQUID TO YARN ON DOUBLE TWISTER

FIELD OF THE INVENTION AND RELATED ART STATEMENT

The present invention relates to a device for applying lubricant liquid to the yarn drawn from a feeding package on the double twister.

The lubricant liquid is used for lessening friction between yarns which are in contact with each other or between the yarn and the other body so as to make it easy to handle the yarn while preventing yarn breakage or damage to the yarn, and, particularly, for preventing damage to the yarn caused when the yarn strikes the balooning constricting cylinder which limits the size of yarn balooning. Many kinds of devices for supplying lubricant liquid to the yarn have been proposed and, as an example thereof, a device has been disclosed in the Utility Model Registration Official Gazette, Laid-open No. Sho 59-160569. This device is provided with a cap to be in contact with the yarn drawn from the feeding package and is disposed on the upper end of a yarn guide tube through which the yarn is passed, wherein a groove opening at the upper side is provided on the cap and a wetting member made of felt is inserted into the groove. The wetting member extends, at one end, into a tank located lower than the abovesaid cap and absorbs lubricant liquid with the aid of capillary action for applying lubricant liquid to the yarn running on the upper surface of the cap.

A device disclosed in the above-quoted Official Gazette permits exact application of lubricant liquid to the yarn. However, this device is liable to be damaged at a part touching the yarn because an appropriate feed quantity of lubricant liquid to the yarn is difficult to set and the wetting member is made of felt.

OBJECT AND SUMMARY OF THE INVENTION

It is an object of the present invention to propose a device for application of lubricant liquid in which a feed quantity to the yarn can be varied and set at an appropriate level.

The present invention is characterized by being provided with: a rigid porous wetting member disposed in a part of the yarn passage through which the yarn drawn from a feeding package passes and adapted to be in contact with the drawn yarn; a tank for reserving lubricant liquid to be applied to the yarn; and a plurality of wicks immersed into lubricant liquid in the tank at one end and brought into contact with the wetting member at the other end.

The abovesaid wicks absorb lubricant liquid reserved in the tank depending on the capillary action thereof and feed the wetting member with this absorbed liquid. Further, the wetting member feeds the liquid to the yarn running while touching the wetting member and is, thanks to rigidity thereof, less susceptible to wear at the surface thereof caused by contact with the running yarn. A feed quantity of lubricant liquid to the yarn is adjusted by properly decreasing the number of wicks which are prepared in a plurality. Reduction in the number of wicks depends on removal or cutting of some pieces of wicks, whereby a feed quantity of lubricant liquid to the wetting member can be reduced.

DETAILED DESCRIPTION OF THE PREFERRED EMBODIMENTS

Figure 2:
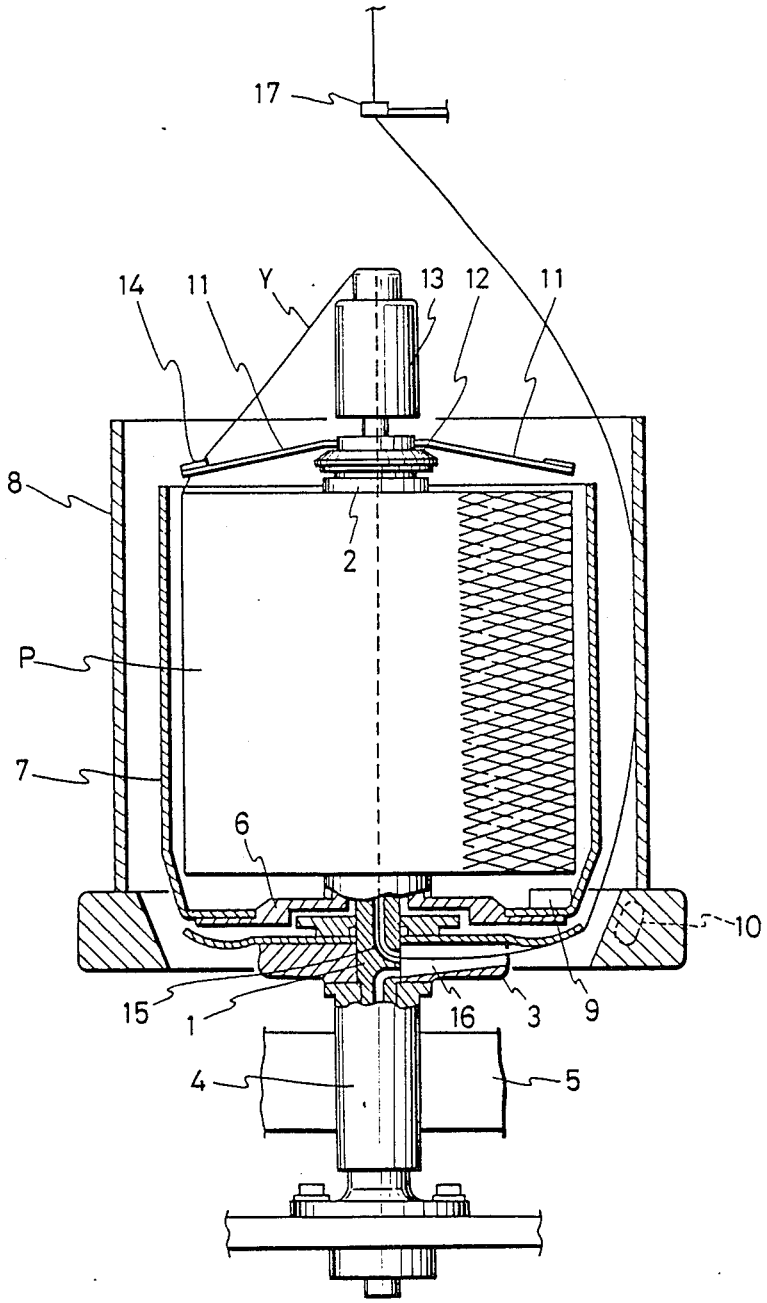
FIG. 2 is a side view of the whole of a double twister.

FIG. 2 shows the whole of a double twister, in which the reference character P indicates a feeding package of yarn. The numeral 1 represents a spindle located in the paper tube 2 of the package P, the spindle 1, yarn reserving disc 3, and wharve 4 being fabricated integrally with each other. A driving belt 5 running along the machine frame drives the spindle 1 at high speed while touching the wharve 4. The package P is mounted on the standing disk 6 rotatably supported by the spindle 1 through a bearing not shown, doubly enclosed by a package cover 7 mounted on and fixed to the standing disk 6 and a balooning constricting cylinder 8 fixed to the machine frame not shown, and kept stationary by an attractive force acting between magnets 9 and 10 provided in the package cover 7 and the balooning constricting cylinder 8, respectively, even during the rotation of the spindle 1. A tensor 12 having two pieces of flyers lying near the top of the spindle 1 is mounted on the disk 6 and, further, a lubricant application device 13 according to the preferred embodiment of the present invention is mounted above the tensor 12.

The yarn drawn from the feeding package P passes through a guide 14 on the tip of a flyer 11 on one side and, after passing through the top end of the lubricant application device 13 and a yarn passage hole 15 formed in the center of the spindle 1, runs downward, goes out through a yarn guide hole 16, rotates around the package cover 7 with the rotation of the spindle 1 and the yarn reserving disk 3, ascends while touching the inner wall of the balooning constricting cylinder 8, and is wound into a wound-up package.

Figure 1:
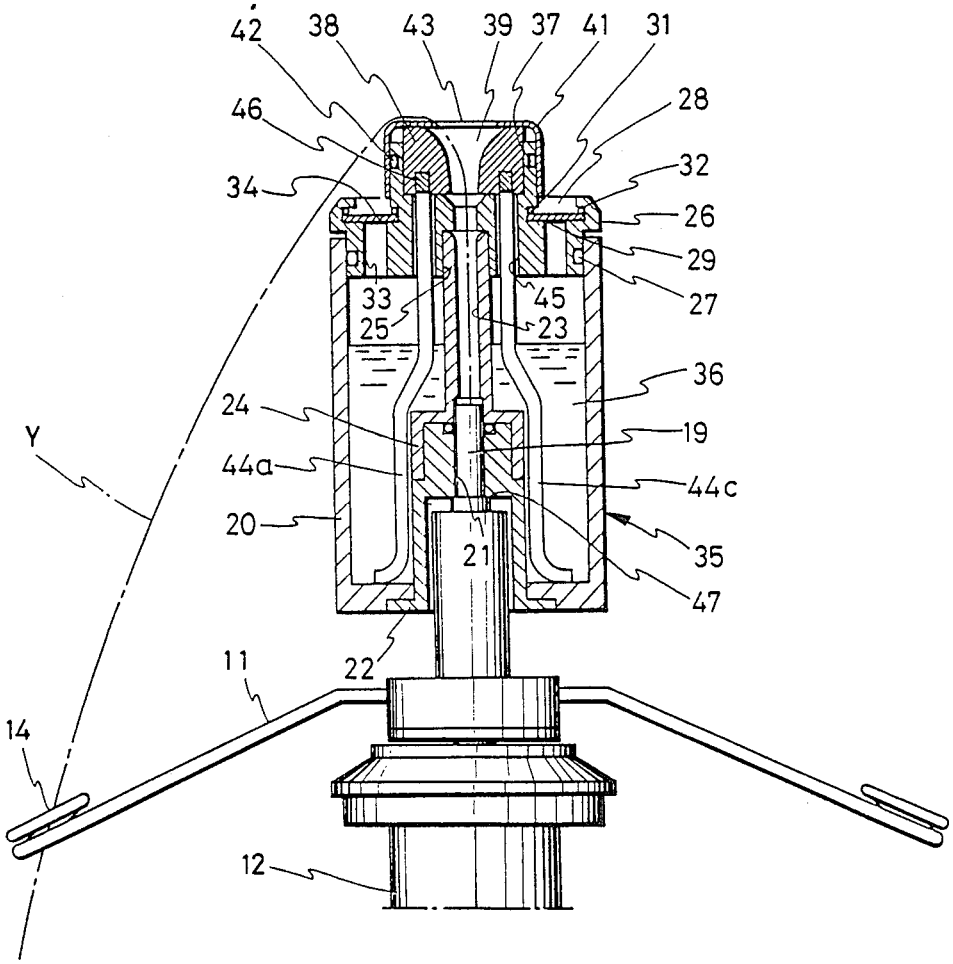
FIG. 1 is a sectional view of a lubricant application device according to the preferred embodiment of the present invention.
Figure 3:
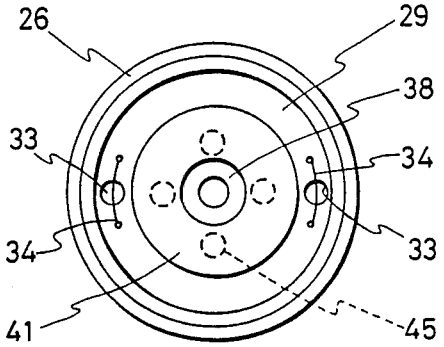
FIG. 3 is a plan view of the above-mentioned device.
Figure 4:
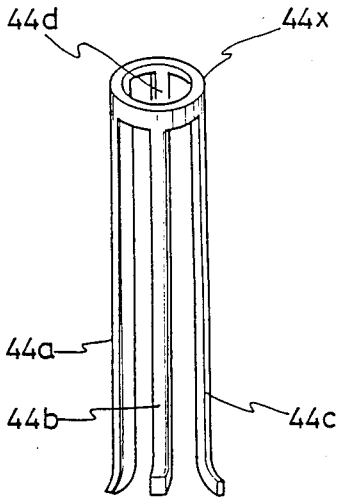
FIG. 4 is a perspective view of wicks.

FIG. 1 is a sectional view of a lubricant application device 13 according to the present invention. The numeral 19 designates a yarn guide hollow tube fixed to the tensor 12 and communicating with the abovesaid yarn passage hole 15. The numeral 20 stands for a cylindrical case made of transparent plastic material and a cylindrical body 22 having a hole 21 detachably engageable with the yarn guide tube 19 is fixed to the center of the lower end of the case 20. A yarn guide tube 24 having a hole 23 extending straight and communicating with the yarn guide tube 19 is fixed to the upper end of the cylindrical body 22, and a lid 26 having a hole 25 detachably fitted on the upper end of the yarn passage tube 24 is removably fixed to an opening part at the upper end of the case 20 through an O-ring 27 provided on the outer periphery of the lid. An annular groove 28 is formed on the upper surface of the lid 26 as shown in FIG. 3, and an annular seal 29 made of urethane rubber is disposed on the bottom of this groove 28 and fixed within the groove 28 by metal rings 31 and 32 so as not to slip off. Oiling holes 33 extending from top to bottom are drilled at the two parts interposing the hole 25 in the groove 28, and slits 34 are formed in positions corresponding to the oiling holes 33 on the seal 29. With the tip of an appropriate oil feeder thrusted into the slit 34, lubricant liquid can be fed into the tank 35 composed of the abovesaid case 20, the tank 35 reserving the fed liquid 36 therein. A recess 37 is formed in the center of the upper end of the lid 26 and a ring-like wetting member 38 is inserted into the recess 37 and fixed thereto. This wetting member 38 is made of porous and rigid polyolefinic resin and the center hole 39 thereof is shaped into a smooth surfaced approximate cone enlarging toward upper space. The numeral 41 indicates a metallic cap for covering the periphery of the wetting member 38 and the center of the upper end of the lid 26, which is detachably fixed through an O-ring 42 provided in the center of the upper end of the lid 26 and is provided with a hole 43 of a suitable size. Further, numerals 44*a* to 44*d* indicate four lines of wicks made of felt and immersed into lubricant liquid 36 in the tank 35 at one end, and the upper end of each of wicks passes through each of four holes formed between holes 25 and 33 on the lid 26, extends upward, and reaches the inside of an annular groove 46 formed on the underside of the wetting member 38. As shown in FIG. 4, these four lines of wicks 44*a*–44*d* are made up into one body with an annular connecting part 44*x* at upper end, and the connecting part 44*x* can be in contact with the wetting member 38 thanks to the position thereof in the abovesaid groove 46 and prevented from slipping off the groove 46 by the upper surface of the lid 26 supporting the connecting part. The structure of a device according to the preferred embodiment of the present invention is as has been described above and is fixed by inserting the upper end of the yarn guide tube 19 into the hole 21 and by mounting the lower end of the central part of the cylindrical body 22 on the stepped part 47 of the yarn guide tube 19. At this time, holes 43, 39, 25, 23, 21, and 15 communicate with each other to form a yarn passage.

Oily lubricant liquid 36 reserved in the tank 35 is absorbed by wicks 44*a*–44*d* exerting capillary action and wets the whole of the wetting member 38. The yarn Y having passed through the flyer 11 is downwardly bent while touching the cap, runs through holes 43, 39, 25, and 23 in turn, and, in the course of such processes, is wetted with lubricant liquid 36 while touching the wetting member 38. The wetting member 38 is rigid and, therefore, not deformed or damaged easily by the yarn which is in contact therewith, or causes no impairment on the yarn as well as no variation in the yarn strength. When the quantity of lubricant liquid 36 applied to the yarn Y is excessive, some of wicks 44*a*–44*d* are cut. In other words, the lid 26 is pulled out from the case 20 together with wicks and some wicks considered unnecessary are cut at the lower end so as to be as short as not reaching the level of lubricant liquid and then the lid 26 is again fixed to the case 20. In this way, a quantity or feed speed of lubricant liquid 36 to be fed to the wetting member 38 is reduced and, as a result, a quantity of lubricant liquid applied to the yarn Y is reduced. Wicks 44*a*–44*d* may be made of porous or pore-ful material capable of exhibiting capillary action of fibrous material, for example, sponge or cotton yarn, and, further, may be separate from each other and are preferably capable of being easily cut or removed. The wetting member 38 may be made of another kind of porous rigid material, for example, sintered ceramic material. The number of wicks 44*a*–44*d* may be any of those more than one, however, when fine adjustment of the feed quantity of lubricant liquid is desired in addition to setting of an appropriate feed quantity depending on reduction in the number of wicks, the purpose is fulfilled by varying the diameter of the hole 43 of the cap 41. That is to say, a quantity of lubricant liquid sticking to the yarn Y can be varied by replacing the cap 41 pulled out from the lid 26 with the other one different in diameter so as to vary a contact area between the yarn Y and the wetting member 38. Supply of lubricant liquid to the tank 35 can easily be performed, as described earlier, through the slit 34, however, the slit 34 is usually closed tight and, even if the lubricant application device 13 is turned upside down, lubricant liquid in the tank never leaks outside from the tank, thereby making handling of the device exceedingly easy.

According to the preferred embodiment of the present invention, a feed quantity of lubricant liquid to the yarn can be varied and set at an appropriate level by varying the number of wicks. Therefore, saving of lubricant liquid and reduction in frequency of supply of lubricant liquid are made possible, whereby stains on the twister frame caused by sticking of lubricant to the yarn are reduced.

What is claimed is:

1. A device configured to be disposed above a feeding package of a double twister, for applying a lubricant to a yarn, said device comprising:

a lid having a yarn passage therein through which the yarn is drawn from the feeding package, a wetting member disposed adjacent the yarn passage and adapted to contact the yarn drawn from the feeding package, a tank in which the lubricant is reserved, a plurality of wicks, one or more of the wicks having a first end in communication with the lubricant in the tank and having a second end in communication with the wetting member whereby said lubricant is transferred by said plurality of wicks from said tank to said wetting member, and a connecting piece for connecting together the second ends of the wicks.

2. A device according to claim 1, wherein the wicks and the connecting piece comprise a unitary structure.

3. A device according to claim 1, wherein said lid further includes at least one hole extending therethrough, and a seal which is adapted to cover said at least one hole.

4. A device according to claim 3, wherein said lid further includes: a groove having an inner periphery and an outer periphery and in which is located said at least one hole and said seal, where said seal is disposed between the inner periphery and the outer periphery of the groove.

5. A device according to claim 3, wherein said seal contains slits in the area directly covering said at least one hole.

6. A device according to claim 1, wherein said wetting member includes a hole through the center thereof, said device further includes:

a removable cap having a hole therein, wherein said cap is adapted to partially cover said hole through the center of said wetting member.

7. A device for applying a liquid to a yarn drawn from a feeding package on a double twister, comprising:

a wetting member arranged to contact said yarn drawn from said feeding package;

a plurality of wicks, at least one of said wicks having a first end in communication with said wetting member and a second end in communication with said liquid, for conveying said liquid to said wetting member; and a connecting member for connecting together the first end of each of said wicks, said connecting member is adapted to be independent of, but in capillary communication with, said wetting member.

8. A device according to claim 7, characterized in that said plurality of wicks and said connecting member comprise a unitary structure.

* * * * *